US005423229A

United States Patent [19]

Schultz et al.

[11] Patent Number: 5,423,229

[45] Date of Patent: * Jun. 13, 1995

[54] APPARATUS AND METHOD FOR DRAINING HIGH PRESSURE FLUID SAMPLES WITHOUT MERCURY

[75] Inventors: Roger L. Schultz, Richardson; Paul D. Ringgenberg, Carrollton, both of Tex.

[73] Assignee: Halliburton Company, Houston, Tex.

[ * ] Notice: The portion of the term of this patent subsequent to Mar. 8, 2011 has been disclaimed.

[21] Appl. No.: 157,657

[22] Filed: Nov. 26, 1993

Related U.S. Application Data

[62] Division of Ser. No. 737,751, Jul. 30, 1991, Pat. No. 5,291,796.

[51] Int. Cl.[6] ..... G01N 1/00

[52] U.S. Cl. ..... 73/863; 73/864.62; 73/864.91

[58] Field of Search ..... 417/415, 537, 443, 498, 417/504, 522, 531, 534, 535, 536, 538, 59, 560; 73/863, 864.62, 864.63, 864.41; 74/25, 841

[56] References Cited

U.S. PATENT DOCUMENTS

| | | | |
|---|---|---|---|
| 1,343,574 | 6/1920 | Miller | 417/504 |
| 1,442,308 | 1/1923 | Vaile et al. | 417/537 |
| 2,217,287 | 10/1940 | McNew | 417/536 |
| 3,043,499 | 7/1962 | Knobloch et al. | 417/536 |
| 4,566,868 | 1/1986 | Menzies | 417/415 |
| 4,817,445 | 4/1989 | Fink | 73/864.63 |
| 5,291,796 | 3/1994 | Schultz et al. | 73/863 |

*Primary Examiner*—Hezron E. Williams
*Assistant Examiner*—Michael J. Brock
*Attorney, Agent, or Firm*—Tracy W. Druce; Lucian Wayne Beavers

[57] ABSTRACT

A sample draining apparatus includes a hydraulic circuit having a sampler vessel and a drain vessel disposed therein. A first pump is located outside the hydraulic circuit and pumps fluid from a fluid source outside the hydraulic circuit into the hydraulic circuit to pressurize the circuit. A second pump is disposed in the hydraulic circuit for circulating fluid in the hydraulic circuit so that a fluid sample flows from the sampler vessel into the drain vessel while the sample is maintained within the closed hydraulic circuit.

19 Claims, 5 Drawing Sheets

APPARATUS AND METHOD FOR DRAINING HIGH PRESSURE FLUID SAMPLES WITHOUT MERCURY

This is a divisional of application Ser. No. 07/737,751, filed on Jul. 30, 1993, now U.S. Pat. No. 5,291,796.

This invention relates to an apparatus for draining high pressure fluid samples without mercury. More particularly, but not by way of limitation, this invention relates to a hydraulic circuit with a series of valves, pumps and pressure gauges which allow the transfer of a reservoir fluid sample from one sample chamber to a second chamber as well as allowing the measurement of the bubble point pressure of the reservoir fluid.

In the oil and gas industry, an operator from time to time, needs to obtain one or more samples of fluid from a wellbore. See U.S. Pat. Nos. 4,787,447 to Christensen, 4,766,955 to Petermann, 4,665,983 to Ringgenberg and 4,502,537 to Carter, Jr.

In general, to obtain a sample, a fluid sample tool is first lowered into the well, such as on a tubing string, a wireline or a slickline. When the tool is at the desired depth, a port (one or more openings) defined on the sampler will open, such as in response to pressure exerted through the well fluid or in response to an electrical actuation from the surface. The open port admits well fluid into a sample retaining chamber within the tool. The port is thereafter closed, the tool is withdrawn from the well, and the sample is taken from the chamber for analysis.

The fluid which one typically wants to analyze is fluid from a subterranean formation or a reservoir intersected by the well so that it can be determined whether the fluid is suitable for being produced.

The sample retaining chamber, or simply sampler chamber, is generally enclosed in a cylindrical housing, as disclosed in U.S. Pat. Nos. 4,665,983 to Ringgenberg and 4,903,765 to Zunkel, both assigned to the assignee of the present invention; U.S. Pat. Nos. 4,665,983 and 4,903,765 are incorporated herein by express reference thereto.

The U.S. Pat. No. 4,665,983 patent discloses a method of draining the chamber containing the reservoir fluid sample. When the testing string is tripped out of the wellbore, the fluid sample may be removed from the downhole sampler valve on site or the upper section of the sampler valve containing the sample chamber may be removed from the lower section thereof by backing off the air chamber case from the sample chamber case and oil chamber mandrel from sample chamber mandrel, and the detached upper section is then transported to a laboratory or shop. In either case, when a fluid sample is to be removed from the sample chamber, the downhole sampler valve is placed in a horizontal position and a drain assembly is then secured thereto. See column 9, lines 33–44.

To drain the sample chamber fluid, as taught by the U.S. Pat. No. 4,665,983 patent, it is necessary to threadedly connect the drain assembly to the predefined drained ports in the sampler valve. The fluid sample will drain from the sample chamber, through the drain assembly, into a collector vessel. To assure complete draining and capture of the fluid sample from the sample chamber, it is desirable to have a pump and a source of mercury sufficient to fill the sample chamber connected to the pressure line running to the bottom nipple.

Mercury is then pumped into the sample chamber of the sampler valve through the drain assembly, and the fluid sample is displaced upwardly into the drain assembly by the heavier mercury. See column 10, lines 1–10.

The method of draining the reservoir fluid filled chamber as disclosed in both U.S. Pat. Nos. 4,665,983 and 4,903,765 has several distinct disadvantages. First, the method disclosed is not a closed system such that there is a potential release of hazardous wellbore fluids and gases (such as hydrogen sulfide). Second, the methods disclosed require the handling of mercury which is a hazardous material. Third, the method disclosed does not allow the determination of the bubble point pressure while the fluid sample is still in the fluid sampler chamber.

SUMMARY OF THE INVENTION

Thus, the hydraulic circuit of the present invention contains a completely closed system such that the fluid can be transferred from the downhole drain to the sample vessel without the exposure of hazardous gas or release of high pressure. Also, the present invention allows for the calculation of the bubble point pressure before the sample is drained.

A feature of the present invention includes having a first pump, hooked up to a fluid reservoir, and an output to one side of the sample chamber. Another feature includes a second pump which will displace fluid in the hydraulic circuit. The third feature includes a sample vessel that contains a piston. Yet another feature includes at least one pressure port in the conduit which leads to a Data Acquisition System. Another feature includes the use of a fluid displacement pump.

An advantage of the present invention allows for the removal of the fluid sample without mercury. Another advantage is the draining of the reservoir under controlled movement of the fluid by use of the displacement pump. Yet another advantage allows for the continual monitoring of the fluid sample pressure. Still another advantage is the low maintenance due to the elimination of pressure relief valves and bleed-off valves present in the prior art systems.

The present invention includes apparatus for draining a high pressure sampler bottle. The specification also discloses an apparatus and method for obtaining the bubble point pressure of the fluid held in the sampler bottle.

The apparatus comprises a fluid reservoir with a first conduit and means for pumping the fluid. A first valve is located on the output side of the sampler bottle, and in line with said sampler bottle is a drain bottle, the drain bottle having valves located on the output and input side.

The apparatus further comprises a second conduit leading from the first valve and means for displacing the fluid from the first valve back into the first conduit. A third conduit line, being connected at one point at an inlet to the sampler bottle, and being connected at a second point on the outlet side of the sample bottle is also included. A fourth valve, placed in line with the third conduit line, is also included.

The apparatus further comprises a means for gauging the pressure of any of the conduit lines along with means for recording the pressure being gauged in the conduit line.

The means for displacing the fluid from the first valve back into the first conduit includes a fluid displacement pump, a direct conduit feeding into the displacement pump, a bypass conduit leading from the direct conduit, feeding back into the first conduit, a relief valve placed in said bypass conduit, an output conduit leading from the fluid displacement pump, and an on/off valve, which is also placed in the output conduit.

A method of obtaining a bubble point pressure of fluid held in a sample bottle comprises the steps of connecting to a fluid reservoir with a pump in stream with said first conduit, then connecting said first conduit to a Data Acquisition System for plotting the pressure increase within the conduit versus time wherein a graphical representation of the pressure within the conduit versus time is obtained. Further, the fluid is pumped to a first pressure, $P_1$, with the pressure being measured by the Data Acquisition System. $P_1$ corresponds to the first change in slope of the graph represented by pressure versus fluid displacement. Pumping is continued to $P_2$ wherein $P_2$ is measured by the Data Acquisition System, and $P_2$ being represented by a second change in slope of the graphical representation of pressure versus fluid displacement. Finally, the graphical representation of pressure versus fluid displacement is plotted.

An apparatus for displacing fluid, which comprises the means for displacing fluid, is also disclosed. This apparatus comprises a cylindrical housing with a first and second port, and a threaded cylindrical sub disposed at one end of the cylindrical housing. A power piston is slidably received in the cylindrical housing, with thread means defined at one end of the power piston.

A first conduit connected to the first port of the cylindrical housing and a second conduit connected to the second port of the cylindrical housing is disclosed. Further disclosed is a means for providing a check valve apparatus between the two ports, with the means for the check valves being disposed between the first and second conduits. Also, there is a means for rotating the threaded sub of the cylindrical housing, which causes the power piston to rotate relative to the cylindrical housing, with a rotation of the power piston causing longitudinal movement of the power piston. There is also disclosed in this application means for applying pressure to the hydraulic circuit, a drain vessel which is connected by a hydraulic line by the sampler bottle, and means for displacing fluid between said vessel drain bottle and being connected to said hydraulic line leading into the sampler bottle.

DESCRIPTION OF THE PREFERRED EMBODIMENT

Figure 1:
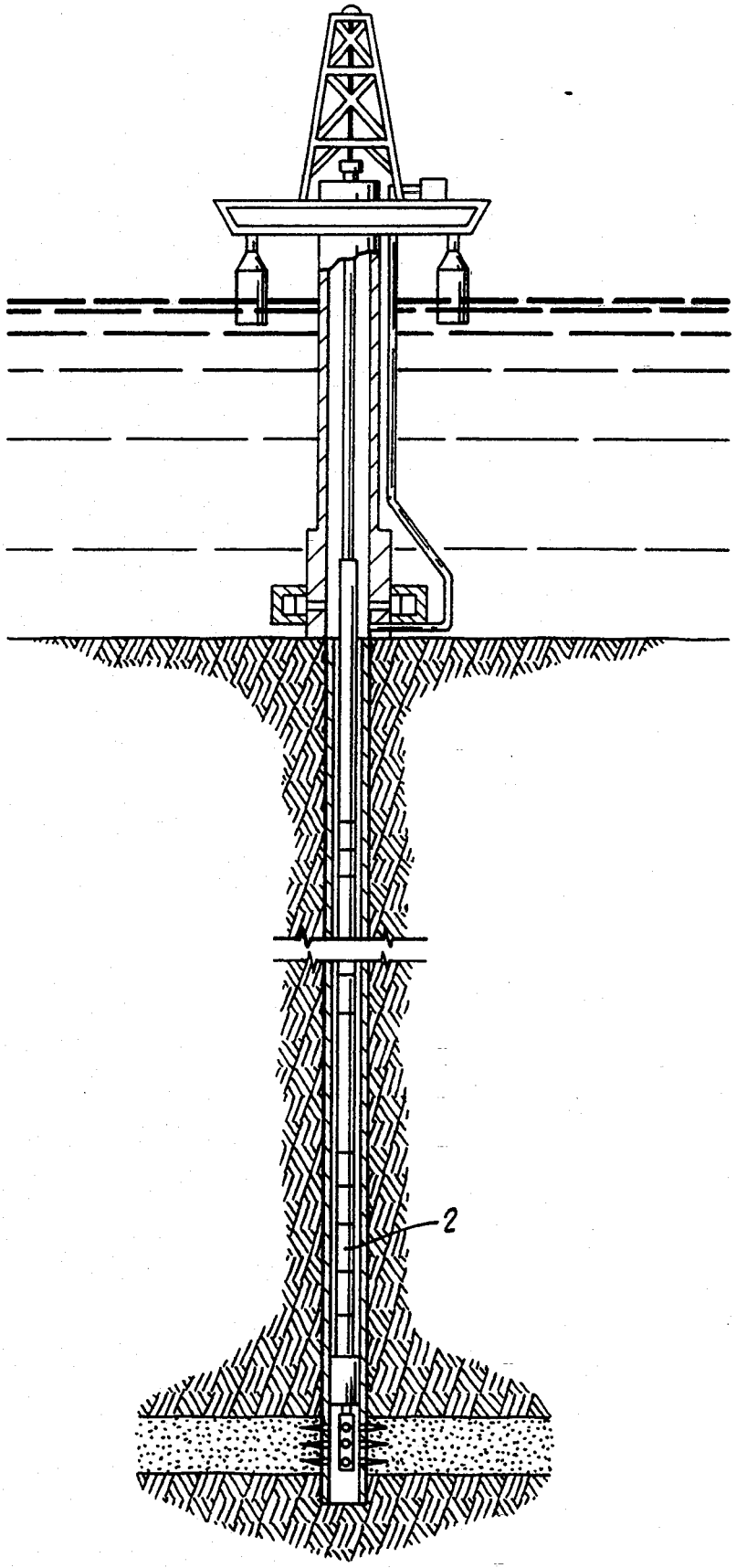
FIG. 1 is a schematic and block diagram depicting an environment in which the preferred high pressure sampler bottle obtains a reservoir fluid sample.

In the description which follows, like parts are generally marked throughout the specification and drawing with the same reference numerals, respectively.

Referring to FIG. 1, a fluid sampling tool 2, representing the high pressure sampler bottle, is lowered into an oil and gas wellbore prior to performing a Drill Stem Test, as will be appreciated by those skilled in the art. An apparatus and method of obtaining a reservoir fluid sample is disclosed and claimed in U.S. Pat. Nos. 4,903,765 and 4,665,983; both of these disclosures having been referred, they are incorporated into the specification by express reference thereto.

After obtaining a sample of fluid, the fluid sampling tool 2, with high pressure sampler bottle contained within, are pulled out of the wellbore. The high pressure sampler bottle can be detached from the downhole tool apparatus; it should be noted that the pressure contained within the sampler bottle has not been allowed to bleed off during this removal stage.

In accordance with the teachings of the present invention, the sampler bottle, which may also be referred to as a sampler vessel, can now be drained into a sealed drain bottle, which may also be referred to as a drain vessel. As will be more fully understood following the detailed description of the present invention, the draining of the sampler bottle, and determination of the bubble point pressure can be carried out at the well site because of the compact size of the hydraulic draining circuit.

Figure 3:
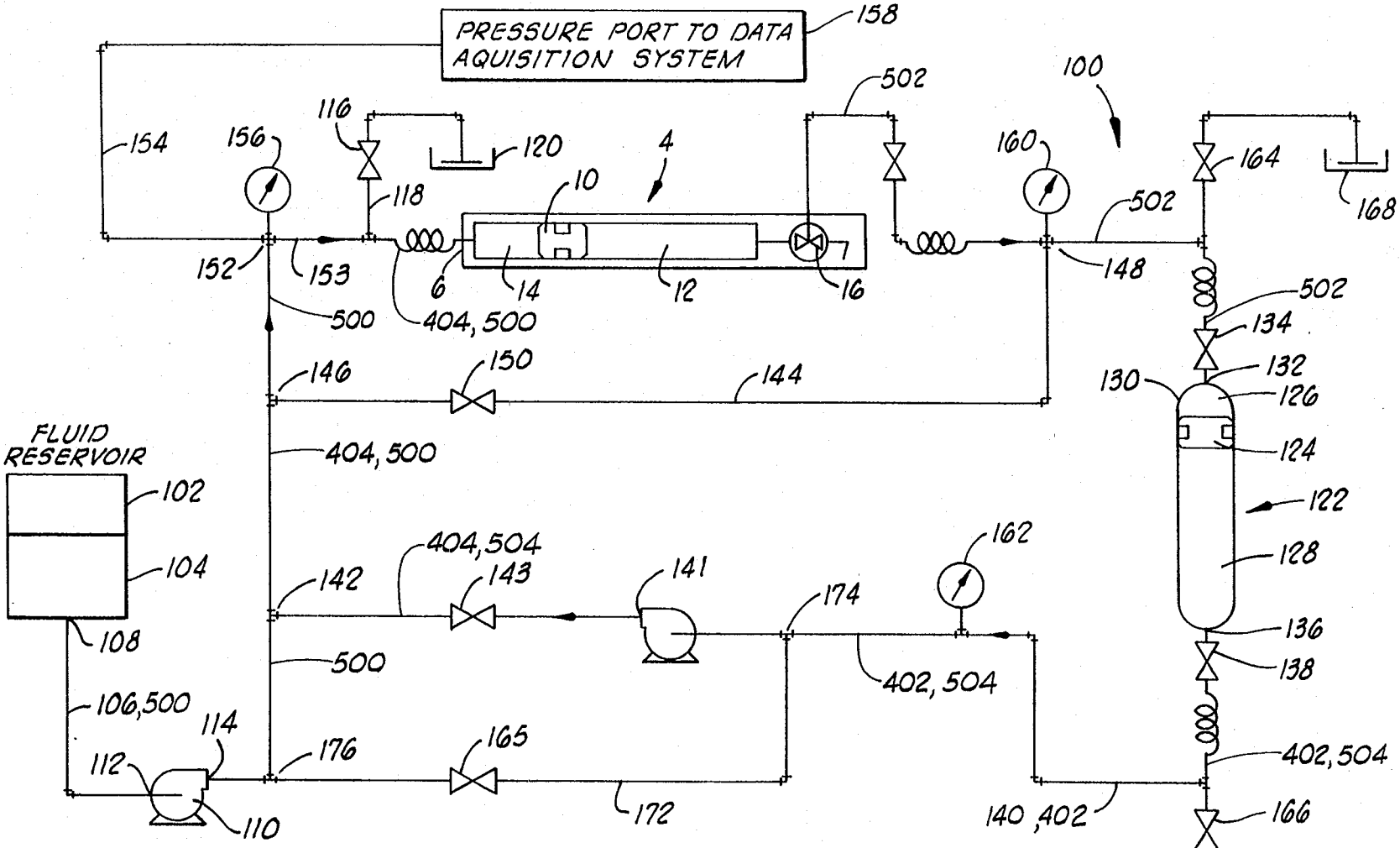
FIG. 3 is a schematic and block diagram depicting the hydraulic circuit of the present invention.

Referring now to FIG. 3, the hydraulic circuit of the present invention is generally shown at 100. The apparatus of the present invention comprises a fluid reservoir 102 which is filled with a suitable fluid such as distilled water 104. Other suitable fluids such as silicon oil can be used. The fluid reservoir is connected to first conduit 106, the first conduit 106 being attached at the bottom 108 of the fluid reservoir 102.

The high pressure sampler bottle 4 is shown schematically in FIG. 3. Sampler bottle 4 includes an inlet face 6 and an outlet face 8 located at the ends thereof. Within the sampler bottle 4, an isolation piston 10 defines a sample chamber 12 and a clean fluid chamber 14. A valve 16 on the downstream end of sampler bottle 4 controls fluid flow therefrom. A second valve 17 downstream of valve 16 can also control fluid flow from sampler bottle 4.

The hydraulic circuit also includes a first pump 110, which includes an inlet 112 and outlet 114, the first pump being attached and in the stream of the first conduit 106. The conduit 106 is connected to the high pressure sampler bottle 4, at the inlet face 6. A first branch 118 of the conduit 106, contains a first circuit valve 116. The outlet from the first circuit valve leads to a bleed off chamber 120 for bleeding pressure in conduit 106.

Figure 2:
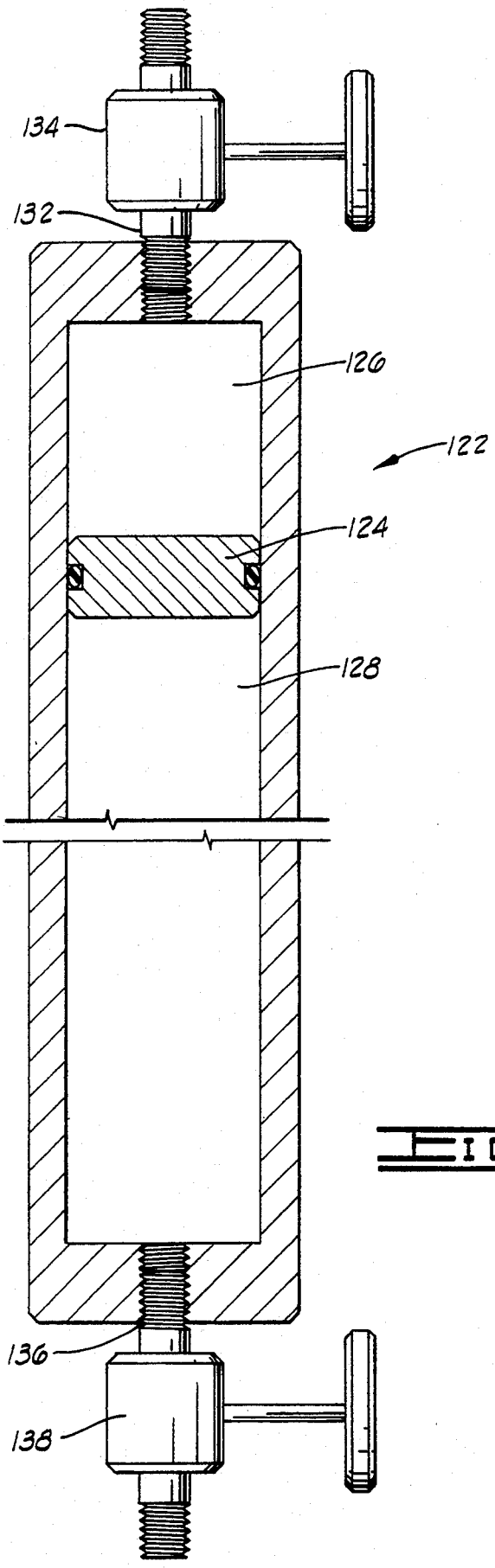
FIG. 2 is a longitudinal schematic depicting the drain bottle.

Also included in the hydraulic circuit is a drain bottle 122, which may also be referred to as a drain vessel 122. The reservoir fluid sample taken from the wellhead of the oil and gas reservoir and located in sampler chamber 12 of the sampler bottle 4 will be transferred to the drain vessel 122. A separation piston 124 is slidably disposed on the inner peripheral of the drain vessel 122. The separation piston 124 forms two chambers, a first drain vessel chamber 126 and a second drain vessel chamber 128. Before the reservoir fluid sample is drained, the separation piston 124 will be located at the upper end 130. At one end of the drain vessel, an inlet face 132 represents the inlet for fluids which will be entering the sample vessel 122. A second circuit valve 134 is placed upstream of the inlet face 132, the second circuit valve 134 being an on and off valve, such as can be purchased from Autoclave Incorporated. These types of valves are also referred to as needle valves, as will be appreciated by those skilled in the art. An enlarged view of drain bottle 122 is shown in FIG. 2.

At the opposite end of the drain vessel, relative to the inlet face 132, is the outlet face 136. Placed downstream of the outlet face 136 will be a third circuit valve 138, which is an on and off type of valve, and is similar to other on and off valves utilized in this hydraulic circuit. Bleed off valve 164 and basin 168 can be referred to as an evacuation means 164, 168 for evacuating fluids from the drain conduit 502 between the sampler vessel 4 and the drain vessel 122.

Figure 5A:
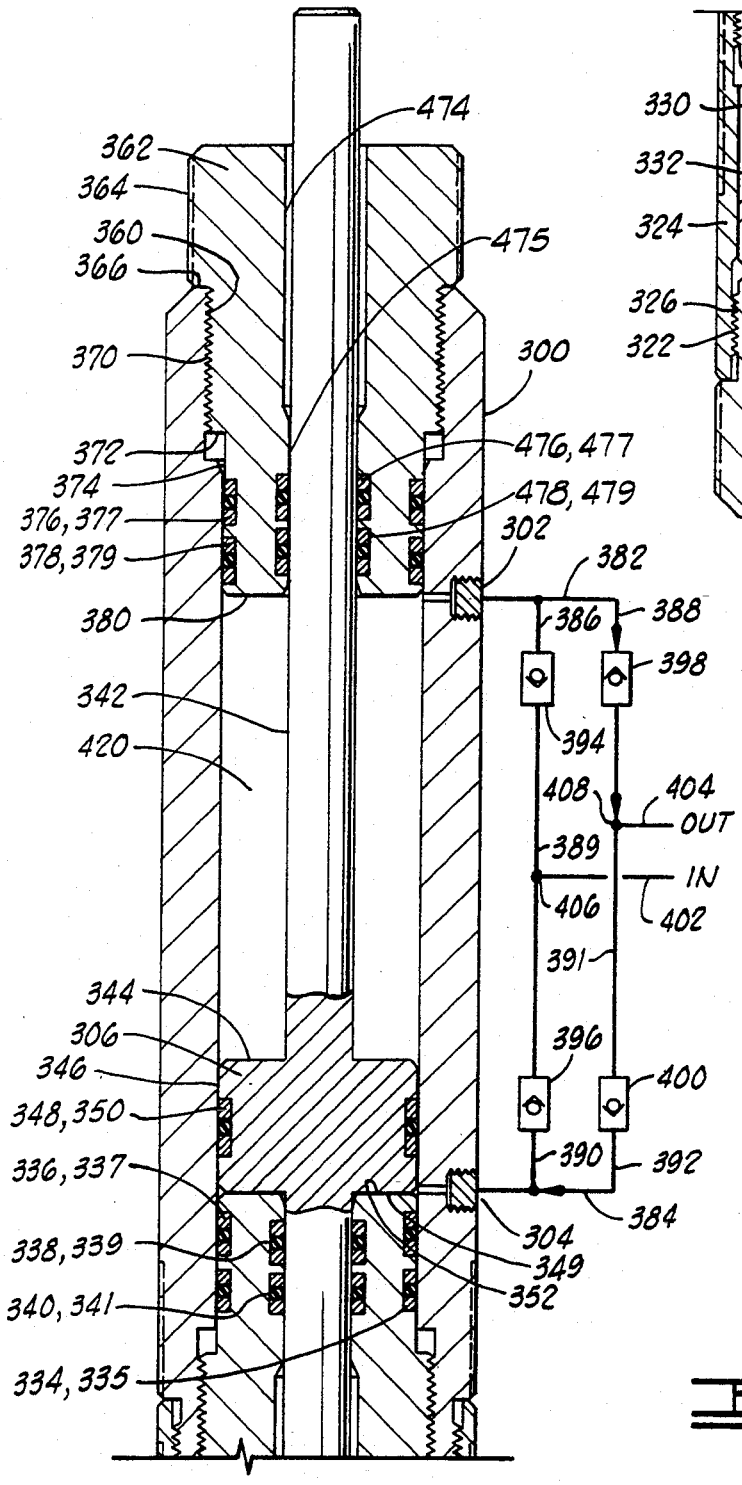
FIGS. 5A and 5B form a longitudinal sectional view of the preferred embodiment of the means for displacing fluid in the hydraulic circuit.
Figure 5B:
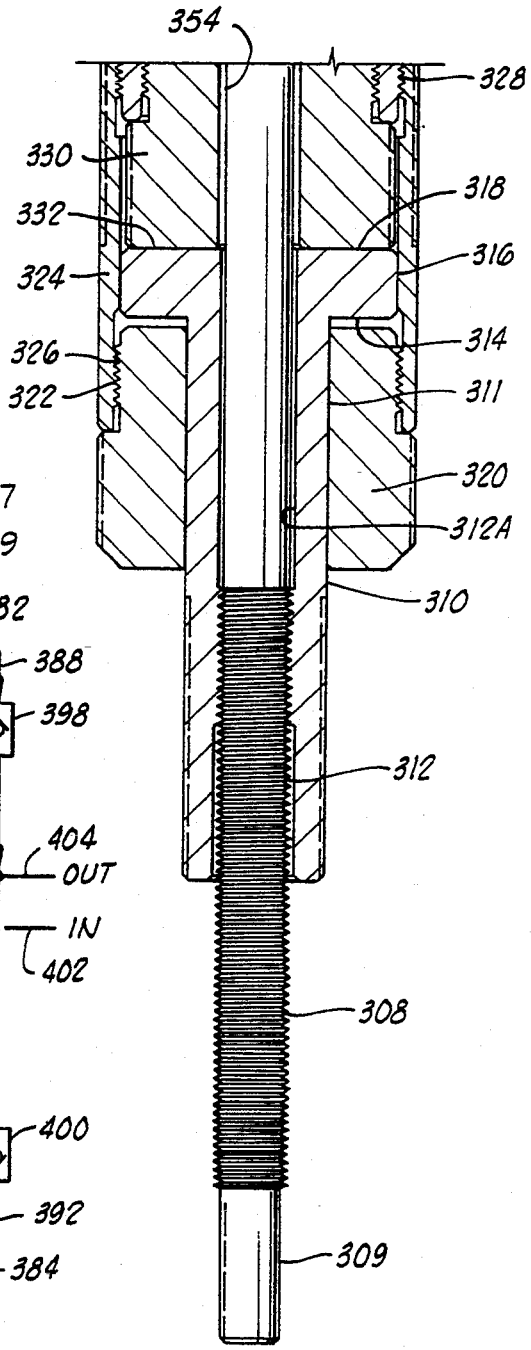

A second conduit 140 leads from the third circuit valve 138. A means for pumping 141 the fluid located in the second conduit 140 is placed in line. Generally, the means for pumping 141 is a displacement pump as shown in FIGS. 5A and 5B; the displacement pump will be discussed in further detail later on in this application. It should be appreciated, however, that other displacement pumps can be utilized in order to displace the fluid located in the conduit 140. An on and off valve 143 is placed in tandem, with conduit 140, downstream of the displacement pump 141. The first conduit 106 and second conduit 140 intersect at 142, at which point the two conduits are in fluid communication.

The hydraulic circuit further comprises a third conduit line, 144, with the third conduit line 144 being connected to the first conduit 106, such that the two conduits are in communication. The point at where the two conduits connect, 146, represent an area upstream of the inlet face 6 of the sampler bottle 4, but downstream of the point of connection at the second conduit 140 and first conduit 106, represented by numeral 142. The third conduit line 144 is also connected to the first conduit line 106 at a second point 148, this second communication being downstream of the sampler bottle 4.

A fourth circuit valve, 150, is placed in tandem with conduit 144, with valve 150 being a two-way valve as previously described.

The hydraulic circuit also includes means for gauging and recording the pressure of the hydraulic circuit. First, the first conduit 106 has attached at a point upstream of the inlet face 6 a two-way directional sleeve 152. The first sleeve 153 directs the first conduit 106 to the sampler bottle 4, while the second sleeve 154 directs the first conduit 106 to a pressure gauge 156 and Data Acquisition System 158. The Data Acquisition System 158 is a pressure sensor which records pressure relative to time. The Data Acquisition System 158 can be connected to a microprocessor, and the pressure can be graphically represented in real time, and plotted continuously through the obtaining of a bubble point pressure and draining of the sampler bottle 4.

A fourth conduit 172 with an on and off valve 165 contained in tandem is disclosed. The fourth conduit 172 intersects the second conduit 140 at 174, and the first conduit at 176.

The hydraulic circuit 100 can contain other pressure gauges located throughout the system which will enable the operator to determine the pressure in the conduit at any given time during either the calculation of the bubble point pressure or draining of the sampler bottle. For instance, pressure gauge 160 can be placed at the intersection of the first conduit and third conduit, downstream of sampler bottle 4. Pressure gauge 162 can be placed in the second conduit 140, at a point downstream of the sampler vessel 122, but upstream of the displacement pump 141.

The hydraulic circuit 100 will also contain two bleed off drain vessel valves, 164 and 166. Both of these valves will lead to fluid basins 168 and 170. Fluid basins 168 and 170 can collect fluid which is bled off from the bleed off valves 164 and 166.

Optionally, the hydraulic circuit 100 can also contain a vacuum pump (not shown). The preferred location of the vacuum pump would be down stream of the sampler bottle 4 and upstream of the drain bottle 122. The vacuum pump will evacuate air and fluid which may be contained in the conduit between the sampler bottle 4 and drain bottle 122.

Figure 4:
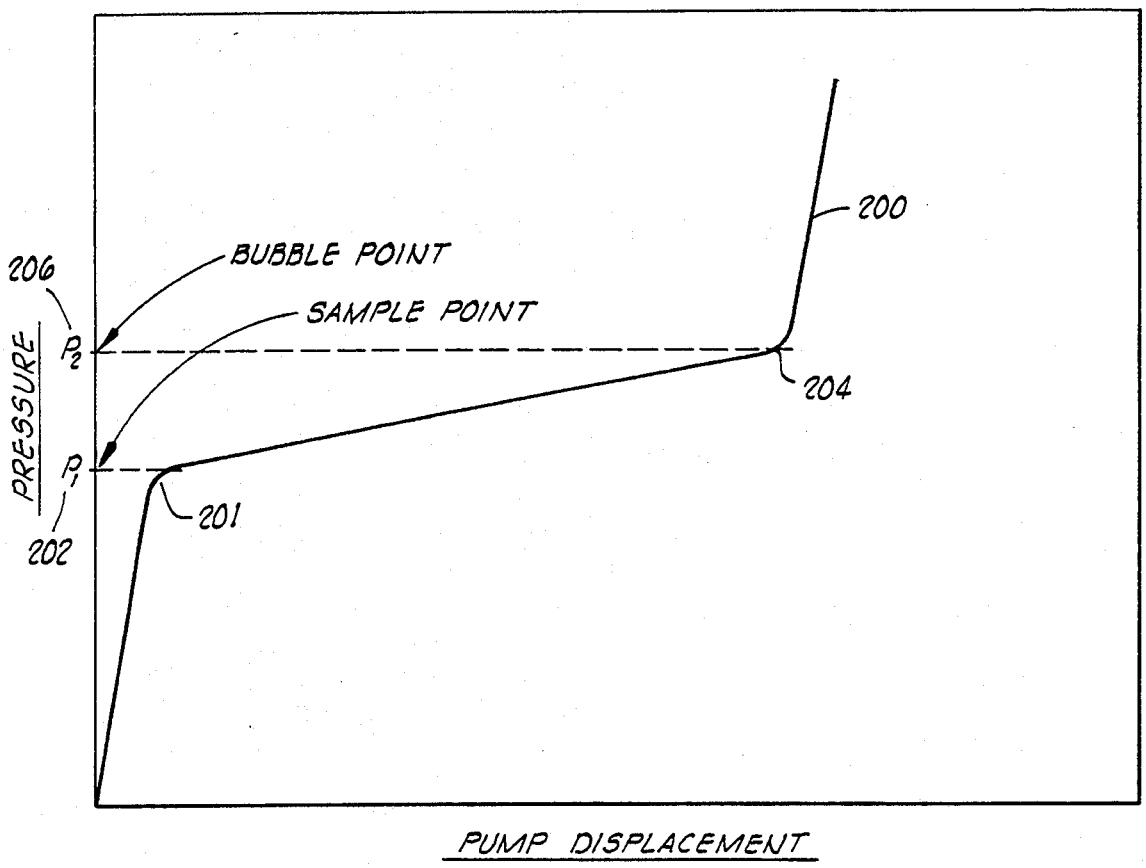
FIG. 4 is a characteristic graphical representation of the pressure of the high pressure sampler bottle versus pump displacement.

Method of Operation:

FIG. 4 is a typical graphical representation of pressure of the high pressure sampler bottle 4 versus pump displacement. Line 200 of FIG. 4 represents the typical pressure increase in the sampler bottle 4 experienced from the fluid in the hydraulic line when being pumped, and when sampler bottle valve 16 is closed. In other words, fluid is being pumped into fluid chamber 14, which acts against piston 10 and causes the reservoir fluid sample in sample chamber 12 to compress. It should be remembered that this reservoir fluid sample may contain oil, gas and water from the subterranean formation.

In order to obtain the bubble point pressure of the reservoir fluid held in sampler bottle 4, first, it is necessary to connect the reservoir of distilled water 102 to the first pump 110 with first conduit 106. As shown in FIG. 3, the first conduit 106 leads to the sampler bottle 4, as well as to the two way directional sleeve 152, which will also lead to the Data Acquisition System 158. The sampler bottle valve 16 is closed. Also valves 150, 116, 143 and 165 are closed. The first fluid pump 110 is used to increase the line pressure until the pressure inside the sampler bottle 4 is reached. The isolation piston 10 will begin to compress the gas and oil sample located within sample chamber 12 when the pump pressure of first pump 110 exceeds the sample pressure. As the pressure in sample chamber 12 is increased further, the gas in the oil and gas sample chamber 12 will continue to compress. When the pressure gets high enough in sample chamber 12, all of the gas will be in solution with the oil of the fluid sample causing the compressibility of the fluid sample to decrease dramatically. This will cause a rapid pressure increase in the fluid chamber 14 and pump pressure as first pump 110 continues to pump at the same volumetric rate.

Referring again to FIG. 4, line 200 shows the characteristic plot of pump displacement versus sample pressure as the gas was compressed into the liquid solution. The first change of slope, 201, represents where the gas begins to compress and indicates the pressure of the oil and gas fluids in sample chamber 12. This pressure is represented by $P_1$, at 202.

The second change of slope, 204, indicates the bubble point of the oil and gas fluid sample, which is represented by $P_2$ at 206. In accordance with the teachings of the present disclosure, the pressure of the oil and gas fluid sample can be observed visually on a pressure gauge 156, or recorded and plotted by the Data Acquisition System 158. The pressure at any given point in the system can be gauged and/or recorded, as deemed necessary and desirable by the operator.

In order to drain the sampler bottle 4, first, it is necessary to close valves 116, 143, 150, and 166. Valves 165, 138, 134 and 164 are opened. Then, with first pump 110 pressure is pumped up to approximately 500 psi above the previously determined bubble point pressure. By doing this, the separation piston 124 in drain vessel 122 will move to the uppermost end, adjacent to the drain vessel inlet 132.

Next, bleed off valve 164 and check valve 165 are closed. The sampler bottle valve 16 is then opened. Valve 143 is also opened. The operator can then begin fluid displacement by starting up the displacement pump 141. At this point, fluid is moving in the hydraulic circuit. As fluid is being displaced, isolation piston 10 moves relative to sample bottle 4. This movement of isolation piston 10 causes the oil and gas sample to be displaced, exiting from sampler bottle 4, into first conduit 106, and into drain vessel 122 in the first drain vessel chamber 126.

Once a predetermined amount fluid has been displaced inside the drain vessel, a displacement volume can now be calculated by subtracting the amount of fluid which has been displaced from this sample bottle. This information can now be utilized when a fluid analysis is performed on the fluid sample.

That portion of conduit 106 connecting fluid reservoir 102 to the inlet 6 of high pressure sampler bottle 4 may generally be referred to as a supply conduit 500. The conduit connecting the outlet of sampler bottle 4 with the inlet of drain bottle 122 may generally be referred to as a drain conduit 502. The conduit connecting the outlet 136 of drain bottle 122 with the intersection 142 with supply conduit 500 can generally be referred to as a discharge conduit 504.

The first pump can be described as a first pump means 110 disposed in the supply conduit 500 for pumping fluid from the fluid reservoir 102 to the sampler vessel inlet 6. The second pump 141 can generally be described as a second pump means 141 disposed in the discharge conduit 504 for pumping fluid from the drain vessel outlet 136 back to the intersection 142 with supply conduit 500.

The first pump 110 serves two general purposes. First as previously described, it can be utilized to pressurize the supply conduit 500 and the high pressure sampler bottle 4 to conduct a bubble point test on the well fluid sample trapped within the high pressure sample bottle 4. After that test has been conducted, and before the sample is transferred from high pressure sampler bottle 4 to drain bottle 122, it is desirable to pressurize the remainder of the system as previously described wherein valves 165, 138, 134 and 164 are opened. The system is pressurized to move the piston 124 to the upper end of drain bottle 122. As previously noted, the system is preferably pressurized to approximately 500 psi above bubble point pressure. This insures that the sample being transferred from high pressure sampler bottle 4 to drain vessel 122 will remain in single phase form as it is transferred.

The actual transfer of the sample is accomplished through the use of pump 141 which will circulate fluid within the hydraulic circuit made up of that portion of supply conduit 500 running from intersection 142 to the inlet 6 of high pressure sampler bottle 4, the drain conduit 502, the drain bottle 122, and the discharge conduit 504.

After the sample has been received in chamber 126 of drain bottle 122, it is desirable to reduce the pressure in the system to below the bubble point pressure. This can be accomplished with the various drain valves previously noted. The purpose of reducing the pressure to below bubble point pressure after the sample is placed in drain bottle 122 is to insure that the sample is in two phase form for purposes of transportation of the drain bottle 122. This prevents excessive pressures from being generated within the drain bottle 122 due to ambient temperature increases and the like, thus greatly increasing the safety of transportation of drain bottle 122.

With regards to the means for displacing fluid within the hydraulic fluid circle, please refer now to FIGS. 5A and 5B. Generally, the means for displacing fluid in the hydraulic circuit includes a cylindrical housing 300 with a first 302 and a second port 304 defined within said housing 300.

A power piston 306 is disposed and received slidably within said cylindrical housing 300. The power piston 306 has defined on one end a threaded portion 308. Also defined with the cylindrical housing, is a threaded sub 310 which has an internal bore 312A. Defined on said internal bore are internal thread connection means 312 which will threadedly mate with the threaded portion 308 of power piston 306.

On the outer diameter of the threaded sub 310, is a first surface 311 which extends to shoulder 314. A second surface, 316, is defined thereon. The threaded sub terminates at radial flat surface 318. A capped sub 320 with external thread connection means 322 is threadedly connected to an external spacer sub 324. The spacer sub 324 contains on the inner diameter thread connection means 326 which will be threadedly mated with threads 322 of the capped sub 320. The spacer sub 324, also contains inner thread connection means at 328 at a second end. Threads 328 located on said spacer sub 324 will be threadedly connected to the cylindrical housing 300. An internal spacer sub 330 is located on the inner periphery of the cylindrical housing. The inner spacer sub 330 contains a first shoulder 332 which will abut the threaded sub 318. The internal bore of internal spacer sub 330 has defined thereon a plurality of grooves 338 and 340. Grooves 338 and 340 contain elastomeric seal means 339 and 341 respectively. The outer periphery of spacer sub 330 has defined thereon a plurality of grooves 334 and 336 which contain elastomeric seal means 335 and 337 respectively. The internal spacer sub 330 terminates at shoulder 349.

The power piston 306 contains a first surface 342 which terminates at radial flat shoulder 344. A second surface, 346, has defined thereon a recessed groove 348. An elastomeric seal means 350 placed within the groove 348. Surface 346 terminates at radially flat shoulder 352 which abuts the shoulder 339 of the internal spacer sub. Referring back to FIG. 5B, a third surface 354 of the power piston extends therefrom as a smooth cylinder until terminating at threads 308. Wrenching flats 309 are defined thereafter.

Referring to FIG. 5A, the cylindrical housing 300 contains internal thread means 360. A top adapter sub 362 contains a first outer diameter surface 364 which terminates at shoulder 366, which in turn leads to external threads 370. External threads 370 of said top adapter sub 362 threadedly connects to the internal thread means 360 of the cylindrical housing. The thread means 370 terminate at shoulder 372 which is a radially flat shoulder extending to fourth surface 374. Surface 374 has defined thereon a plurality of grooves, 376 and 378, which have defined therein elastomeric means 377 and 379. Fourth surface 374 ends at radially flat shoulder 380. Top adapter sub 362 has a first internal bore 474 and a second internal bore 475. Second internal bore 475 has defined thereon has a plurality of grooves 476 and 478. Grooves 476 and 478 contain elastomeric seal means 477 and 479 respectively.

Connected to the output 302 and input ports 304, are two conduits. The first conduit 382 has a first branch 386 and a second branch 388. The second conduit 384 has a first branch 390 and a second branch 392.

Branch conduit 386 has disposed therein a check valve 394 which allows fluid to flow into conduit 382 from a joining conduit 389, but prevents flow in the opposite direction. A check valve 396 disposed in branch conduit 390 allows fluid to flow into conduit 384 from joining conduit 389, but prevents flow in the opposite direction. Joining conduit 389 joins check valves 394 and 396 in fluid communication.

Conduit 388 contains a check valve 398 and conduit 392 contains a check valve 400. Check valve 398 allows fluid to flow out of conduit 382 and into a joining conduit 391, but prevents fluid flow in the opposite direction. Check valve 400 allows fluid to flow out of conduit 384 and into joining conduit 391, but prevents fluid flow in the opposite direction. Joining conduit 391 places check valves 399 and 400 in fluid communication.

The conduit connecting the drain bottle outlet with joining conduit 389 may generally be referred to as input line 402. Input line 402 is connected to joining conduit 389 at intersection point 406.

The conduit connecting joining conduit 391 with the sampler bottle inlet may generally be referred to as output line 404. Output line 404 is connected to joining conduit 391 at intersection point 408.

It should be noted that in order to move the power piston longitudinally the threaded sub 310 can be rotated either manually or by some automatic mechanical means. In order to move the piston, the threaded sub, which is slidably received within the cylindrical housing, is rotated in a counterclockwise or clockwise rotation. Because of thread connection means 312 located on the inner diameter of the threaded sub 310, as well as the external thread 308 located on said power piston 306, the rotation of the threaded sub 310 causes the longitudinal movement of the power piston 306.

As power piston 306 moves longitudinally in a first direction toward first port 302, the fluid in cylindrical bore, or chamber 420 will be forced out of first port 302, through conduit 382, check valve 398, joining conduit 391 and into output conduit 404. At the same time, fluid from the circuit will be drawn into cylindrical bore 420 from input conduit 402 through conduit 389, check valve 396, conduit 390, conduit 384 and port 304. Fluid from the circuit will thus accumulate in chamber 420 between shoulder 349 of spacer sub 330 and radially flat shoulder 352 of piston 306 as piston 306 forces fluid from chamber 420 through first port 302.

In similar fashion, as power piston 306 is moved longitudinally in a second direction toward second port 304, fluid is forced out of chamber 420 through second port 304, conduit 384, conduit 392, check valve 400, joining conduit 391, and into output conduit 404. As the same time, fluid is drawn into chamber 420 through port 302, conduit 382, conduit 386, check valve 394, joining conduit 389 and input conduit 402.

Thus, it is apparent that the apparatus of the present invention readily achieves the advantages mentioned as well as those apparent therein. While certain preferred embodiments of the invention have been illustrated for the purpose of this disclosure, numerous changes in the arrangement and construction of parts may be made by those skilled in the art, which changes are embodied within the scope and spirit of the present invention as defined by the appended claims.

What is claimed is:

1. Apparatus for displacing fluid comprising:

a housing having a cylindrical bore, said housing having first and second ports defined therein communicated with said bore;

a power piston slidably disposed in said cylindrical bore;

a piston shaft extending from said power piston, said shaft having a male thread defined thereon;

a cylindrical sub rotatably disposed in one end of said housing, said sub having a female thread defined therethrough, said male thread of said shaft being received in said female thread of said sub so that said piston and shaft are moved longitudinally relative to said housing when said sub is rotated relative to said shaft;

an input line communicated with said first and second ports;

an output line communicated with said first and second ports; and check valve means operably associated with said first and second ports for allowing fluid to enter said cylindrical bore from said input line while simultaneously allowing fluid to be expelled from said cylindrical bore through said output line as said piston moves longitudinally.

2. The apparatus of claim 1, wherein said first and second ports are located at longitudinally opposite ends of said cylindrical bore so that as said piston moves in a first direction toward said first port, fluid is forced out of said bore through said first port into said output line and fluid is drawn into said bore through said second port from said input line; and so that as said piston moves in a second direction toward said second port, fluid is forced out of said bore through said second port into said output line and fluid is drawn into said bore through said first port from said input line.

3. The apparatus of claim 2, wherein said check valve means comprises:

a first check valve disposed between said input line and said first port, so that fluid in said input line flows only in a direction toward said first port when said piston moves in said second direction;

a second check valve disposed between said input line and said second port, so that fluid in said input line flows only in a direction toward said second port when said piston moves in said first direction;

a third check valve disposed between said output line and said first port, so that fluid flows only in a direction from said first port toward said output line when said piston moves in said first direction; and a fourth check valve disposed between said output line and said second port, so that fluid flows only in a direction from said second port toward said output line when said piston moves in said second direction.

4. The apparatus of claim 1, wherein said means for moving said power piston comprises:

a piston shaft extending from said power piston, said shaft having a male thread defined thereon; and a cylindrical sub rotatably disposed in one end of said housing, said sub having a female thread defined therethrough, said male thread of said shaft being received in said female thread of said sub so that said piston and shaft are moved longitudinally relative to said housing when said sub is rotated relative to said shaft.

5. The apparatus of claim 1, wherein said check valve means is a means for allowing one-way fluid flow only, in a direction from said input line into said bore and from said bore into said output line.

6. The apparatus of claim 1, wherein said input line and said output line are connected, so that a closed hydraulic circuit is formed thereby.

7. The apparatus of claim 6, wherein said check valve means is a means for allowing fluid from said hydraulic circuit to enter said bore through said second port from said input line and to simultaneously exit said bore through said first port into said output line as said piston moves in a first direction;

said check valve means also being a means for allowing fluid from said hydraulic circuit to enter said bore through said first port from said input line and to simultaneously exit said bore through said second port into said output line as said piston moves longitudinally in a second direction.

8. The apparatus of claim 7, wherein said first and second ports are located at longitudinally opposite ends of said bore, and wherein;

said first direction is toward said first port and said second direction is toward said second port.

9. The apparatus of claim 6, wherein said check valve means is a means for allowing one-way fluid flow only in a direction from said input line into said bore and from said bore into said output line, so that fluid circulates in said hydraulic circuit.

10. Apparatus for transferring a fluid sample comprising:

a sampler bottle containing said fluid sample, said sampler bottle having a sampler bottle inlet and a sampler bottle outlet;

a drain bottle having a drain bottle inlet and a drain bottle outlet, said drain bottle inlet being connected to said sampler bottle outlet;

a housing having a cylindrical bore defined therein, said housing having first and second ports defined therein communicated with said bore, said ports being located at longitudinally opposite ends of said cylindrical bore;

an output line communicated with said first and second ports, said output line being connected to said sampler bottle inlet;

an input line communicated with said first and second ports, said input line being connected to said drain bottle outlet line, thereby forming a closed hydraulic circuit;

a power piston slidably disposed in said cylindrical bore;

means for moving said power piston longitudinally in said cylindrical bore; and check valve means operably associated with said first and second ports for allowing fluid in said output line to flow only in a direction toward said sampler vessel inlet.

11. The apparatus of claim 10 wherein said sampler bottle is a high pressure sampler bottle containing a reservoir fluid sample taken from an oil and gas well bore.

12. The apparatus of claim 10 wherein said check valve means is a means for allowing said piston to force fluid out of said bore through said output line and to simultaneously draw fluid into said bore through said input line, thereby transferring said fluid sample from said sampler bottle to said drain bottle.

13. The apparatus of claim 10 wherein said piston is a reciprocating piston, said piston being capable of moving longitudinally in a first direction toward said first port and in a second direction toward said second port.

14. The apparatus of claim 13 wherein said check valve means is a means for allowing said piston to force fluid out of said bore through said first port into said output line and to draw fluid into said bore from said input line through said second port as said piston moves longitudinally in said first direction; and said check valve means also being a means for allowing said piston to force fluid out of said bore through said second port into said output line, and to draw fluid into said bore from said input line through said first port as said piston moves longitudinally in said second direction.

15. The apparatus of claim 13 wherein said check valve means comprises:

a first check valve disposed between said input line and said first port, so that fluid in said input line flows only in a direction toward said first port when said piston moves in said second direction;

a second check valve disposed between said input line and said second port, so that fluid in said input line flows only in a direction toward said second port when said piston moves in said first direction;

a third check valve disposed between said output line and said first port, so that fluid flows only in a direction from said first port toward said output line when said piston moves in said first direction; and a fourth check valve disposed between said output line and said second port, so that fluid flows only in a direction from said second port toward said output line when said piston moves in said second direction.

16. The apparatus of claim 10 wherein said means for moving said piston comprises:

a cylindrical sub rotatably disposed in one end of said housing, said sub having a female thread defined therethrough; and a piston shaft extending from said power piston, said shaft having a male thread defined thereon, said male thread being received in said female thread of said sub so that said piston and said shaft are moved longitudinally relative to said housing when said sub is rotated relative to said shaft.

17. Apparatus for displacing fluid comprising:

a housing having a cylindrical bore, said housing having first and second ports defined therein communicated with said bore;

a power piston slidably disposed in said cylindrical bore;

means for moving said power piston longitudinally in said bore relative to said housing;

an input line communicated with said first and second ports;

an output line communicated with said first and second ports, said input line and said output line being connected so that a closed hydraulic circuit is formed thereby;

check valve means operably associated with said first and second ports for allowing fluid to enter said cylindrical bore from said input line while simultaneously allowing fluid to be expelled from said cylindrical bore through said output line as said piston moves longitudinally;

a sampler vessel containing a fluid sample disposed in said hydraulic circuit, said sampler vessel having a sampler vessel inlet and a sampler vessel outlet, said output line being connected to said sampler vessel inlet; and a drain vessel disposed in said hydraulic circuit between said sampler vessel and said input line, said drain vessel inlet being connected to said sampler vessel outlet, and said drain vessel outlet being connected to said input line.

18. The apparatus of claim 17, wherein said check valve means is a means for allowing fluid in said output line to flow only in a direction toward said sampler vessel inlet, so that said fluid sample is forced out of said sampler vessel and into said drain vessel as said piston moves longitudinally.

19. The apparatus of claim 18, wherein said sampler vessel is a high pressure sampler bottle containing a fluid sample taken from an oil and gas well bore.

* * * * *